US005584111A

United States Patent [19]

Chen

[11] Patent Number: 5,584,111

[45] Date of Patent: Dec. 17, 1996

[54] SLIDE FASTENER CONSTRUCTION MACHINE

[76] Inventor: Shih C. Chen, No. 55, Ming Te Road, Te Yin Tsun, Wu-Guu Shiang, Taipei Hsien, Taiwan

[21] Appl. No.: 446,279

[22] Filed: May 22, 1995

[51] Int. Cl.[6] ..... B29D 5/00; A41H 37/06; B23P 19/04

[52] U.S. Cl. ..... 29/33.2; 29/410; 29/766

[58] Field of Search ..... 29/410, 408, 769, 29/33.2, 34 A, 766

[56] References Cited

U.S. PATENT DOCUMENTS

| | | | |
|---|---|---|---|
| 3,634,922 | 1/1972 | Burbank et al. | 29/33.2 X |
| 3,665,879 | 5/1972 | Sohr | 29/410 |
| 4,321,733 | 3/1982 | Yoshida | 29/408 X |
| 5,058,246 | 10/1991 | Fujisaki et al. | 29/410 X |

FOREIGN PATENT DOCUMENTS

| | | | |
|---|---|---|---|
| 1116382 | 8/1959 | Germany | 29/410 |

*Primary Examiner*—William R. Briggs
*Attorney, Agent, or Firm*—Bacon & Thomas

[57] ABSTRACT

Provided is an improvement to the slide fastener constructing machine. The improvement provides a tooth-notching unit for forming a notch on each tooth on the stringer produced by a stringer producing unit which is a conventional unit and subsequently collected by a stringer collecting unit which is also a conventional unit. The tooth-notching unit includes a base having a passage allowing the stringer of teeth to pass therethrough and a grinding wheel or a circular disk cutter as cutting means provided on top of the passage for cutting a notch on top of each tooth on the stringer. To clear away rubbish produced by the notching process, various devices are provided including brushes and vacuum cleaners. The tooth-notching unit allows the slide fastener constructing machine to produce stringers of teeth that can be stitched securely to clothing. Its construction also allows easy maintenance.

13 Claims, 12 Drawing Sheets

SLIDE FASTENER CONSTRUCTION MACHINE

BACKGROUND OF THE INVENTION

1. Field of the Invention

The present invention relates to slide fasteners, and more particularly, to an improvement made to a slide fastener constructing machine.

2. Description of Prior Art

FIGS. 1 and 2 show slide fasteners constructed using conventional machines. The opposite stringers of teeth 11, 12 (or coils) on either sides of the slide fastener are secured by the stitches 110, 120 to the joining edges 210, 220 (which are usually folded) of the clothing 21, 22. In order to allow the two stringers of teeth 11, 12 to be firmly interconnected with each other, the front of each tooth should be extended from the edge of the clothing by a length of P1 as illustrated in FIG. 2. In conventional ways, the slide fastener is stitched to such articles as clothing or purses by making stitches at the nearest place to the teeth. As the folded portions 210, 220 on the edges of the clothing are upright disposed during stitching process so that the stitches can be made at the place on the clothing 21, 22 nearest to the stringers of teeth 11, 12. After that the unfolded portion on the clothing 30 is turned back to form a final production shown in FIG. 3A. FIG. 3B shows the interconnection of the two stringers of teeth.

It is a drawback of the foregoing way of making the slide fastener that, when the stitches are made to the clothing, the needle applies a force in the direction which also cause the teeth to withdraw upwards. This causes, as illustrated in FIG. 3B, the front of the teeth to extend from the edge of the clothing with a distance P2 that is much shorter than the required distance P1. Such products would normally pass the quality control, but when they are used on clothing or purses, some of the teeth cannot be properly interconnected.

One solution to the problem is to provide a flat portion on the teeth so that the teeth would not withdraw when applying the stitches. However, since the stringer of teeth is consecutively formed in a chain, the technology to form such a flat portion on the teeth is still difficult to achieve. The other solution is to use manual labor. However, this would greatly increase the manufacture cost. There still exist a need for a method that can produce slider fasteners with the teeth securely stitched to the clothing as well as securely interconnected.

SUMMARY OF THE INVENTION

It is a primary objective of the present invention to provide a slide fastener constructing machine used to produce stringers of teeth having a stitch, fixing means that can be stitched securely to clothing.

It is another objective of the present invention to provide a slide fastener constructing machine which allows easy maintenance.

In accordance with the foregoing and other objectives of the present invention, there is provided an improvement to the slide fastener constructing machine. The improvement provides a tooth-notching unit for forming a stitch fixing means on each tooth on the stringer produced by a stringer producing unit which is a conventional unit and subsequently collected by a stringer collecting unit which is also a conventional unit. The tooth-notching unit includes a base having a passage allowing the stringer of teeth to pass therethrough and a grinding wheel or a circular disk cutter as cutting means provided on top of the passage for cutting a stitch fixing means (namely, notch) on top of each tooth on the stringer.

In one of preferred embodiments, a slide fastener constructing machine in accordance with the present invention, comprising a stringer producing unit for producing a stringer of teeth; means for guiding the stringer, said guiding means being provided with a base and at least a passage on said base for allowing the stringer of teeth to pass therethrough; a tooth-notching unit provided with cutting means, said tooth-notching means receiving the stringer of teeth from said guiding means, and said cutting means cutting a portion of the top surface of each tooth of the stringer away to form a stitch fixing means thereon as the stringer passes beneath said cutting means; a stringer collecting unit for collecting the stringer having teeth notched by said tooth-notching unit; and stitching means, receiving the stringer from said stringer collecting unit, for making stitches through the stitch fixing means on each tooth of the stringer to stitch the stringer to an article.

In various preferred embodiment, the passage is provided with a width allowing one stringer to pass therethrough; or it can be provided with a width allowing a pair of stringers to pass therethrough. In addition, the base can be provided with two parallel passages allowing a pair of stringers to pass respectively therethrough.

The base can be provided with position-adjustment means so that it is adjustable in horizontal and vertical positions. It can also be detachably provided on a guiding base which guides the stringer of teeth into the notching unit.

To clear away rubbish produced by the notching process, a rubbish drainage opening is provided on the bottom of the base for draining rubbish produced by notching each tooth on the stringer. A rubbish-cleaning unit can be provided in subsequent to the notching unit for clearing away the rubbish produced by notching each tooth on the stringer. Vacuum cleaners can be further used for clearing away the rubbish.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENTS

Figure 1:
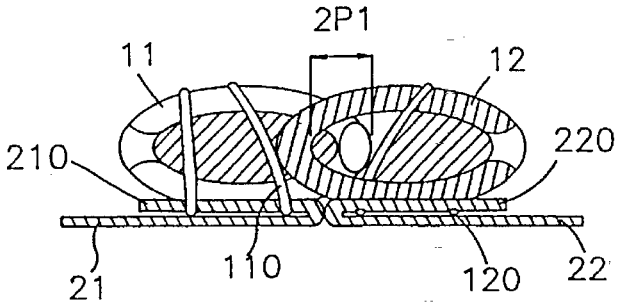
FIG. 1 PRIOR ART
FIG. 1 is a sectional view of a slide fastener constructed using a prior art machine.
Figure 3B:
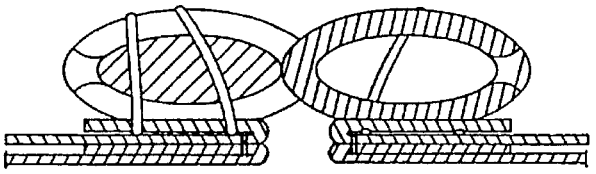
FIG. 3B PRIOR ART
FIG. 3B shows how the two stringers of teeth in the slide fastener of FIG. 1 are interconnected with each other.
Figure 2:
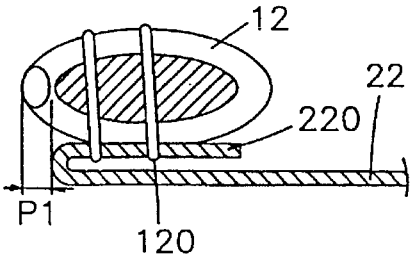
FIG. 2 PRIOR ART
FIG. 2 is a sectional view of one stringer of teeth in the slide fastener of FIG. 1.
Figure 3A:
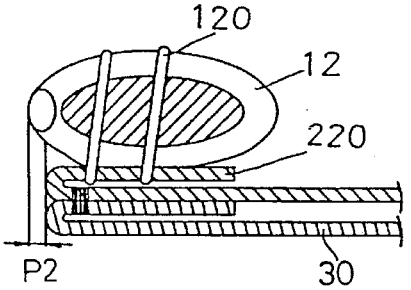
FIG. 3A PRIOR ART
FIG. 3A shows how one stringer of teeth of FIG. 1 is stitched to a piece of clothing.
Figure 4:
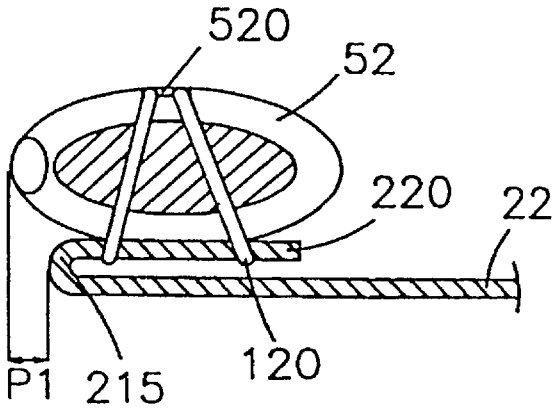
FIG. 4 shows a first slide fastener constructed using a machine according to the present invention.
Figure 4A:
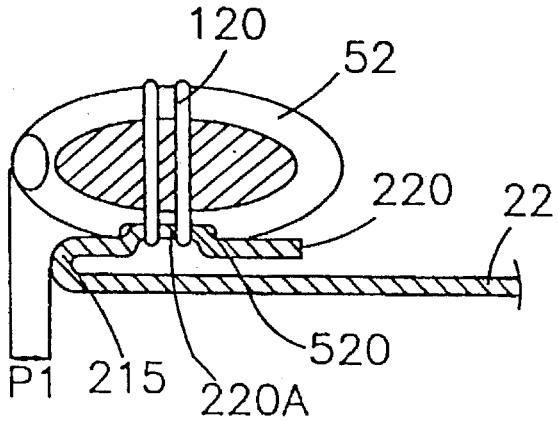
FIG. 4A shows a second slide fastener constructed using a machine according to the present invention.

Referring to FIGS. 4 and 4A, in a slide fastener constructed using a mechanism according to the present invention the thread 120 for securing the teeth 52 can be stitched either at the top of at the bottom of the teeth 52. It is an important aspect of the present invention that a stitch fixing means (namely, notch) 520 is formed on the teeth 52, as illustrated in FIG. 4, or on the folded portion 220 a recession 220A can be formed there, as illustrated in FIG. 4A, either way allowing the teeth 52 to be stitched to the folded portion 220 of a piece of clothing 22. Since the thread 120 is bounded by the notch 520, the teeth 52 would not be slipped off position when making stitches on the edge 215 of the folded portion 220. In addition, the notch 520 on the teeth 52 also allows the thread 120 to stitch the teeth 52 securely on the clothing. As a result, moving the sliding tab would not cause the teeth 52 to loose and make the slide fastener inoperable.

Figure 5:
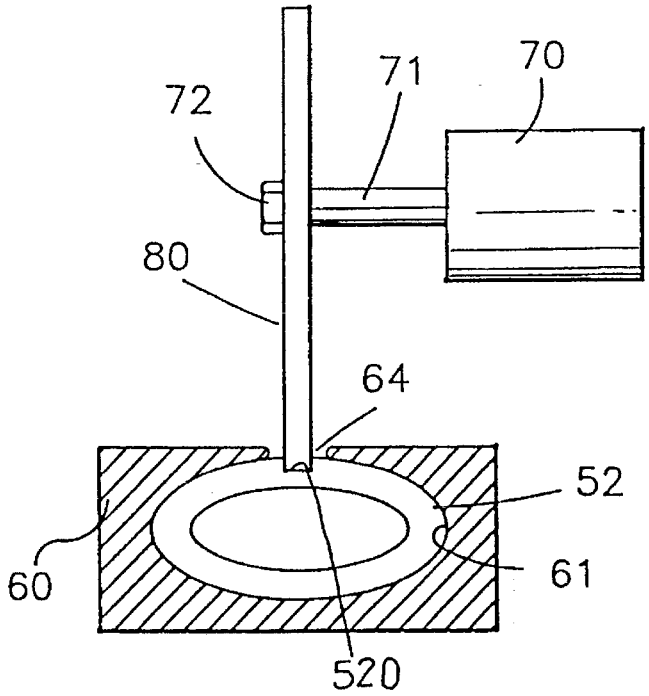
FIG. 5 shows the first preferred embodiment of a tooth-notching unit provided in a slide fastener constructing machine according to the present invention.
Figure 5A:
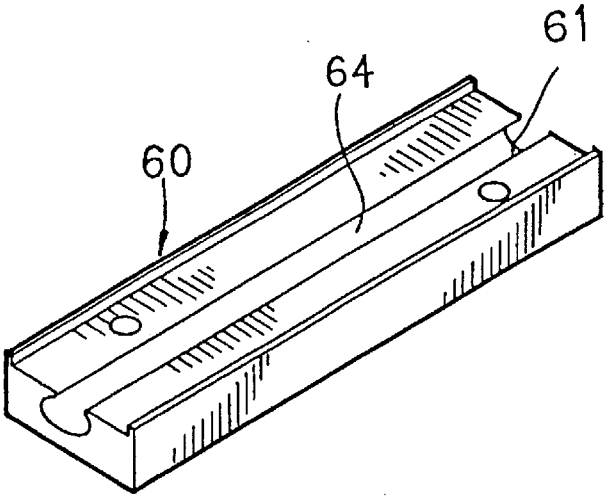
FIG. 5A shows a base portion provided in the tooth-notching unit according to the present invention.

FIGS. 5 and 5A shows a tooth-notching unit according to the first preferred embodiment of the present invention used to form a notch on each tooth of the slider fastener. The tooth-notching unit includes a guiding base 60 having a passage 61 therethrough. The cross section of the passage 61 is shaped the same as that of the teeth 52. An opening 64 is provided on top of the passage 61, allowing a grinding wheel 80 or a circular disk cutter (not shown) to be inserted into the passage 61. A motor 70 is used to drive the grinding wheel 80. In operation, the teeth 52 are guided one by one through the passage 61 and when each passing below the grinding wheel 80, the top portion is cut away by the grinding wheel 80 to form a notch 520 there.

Figure 6:
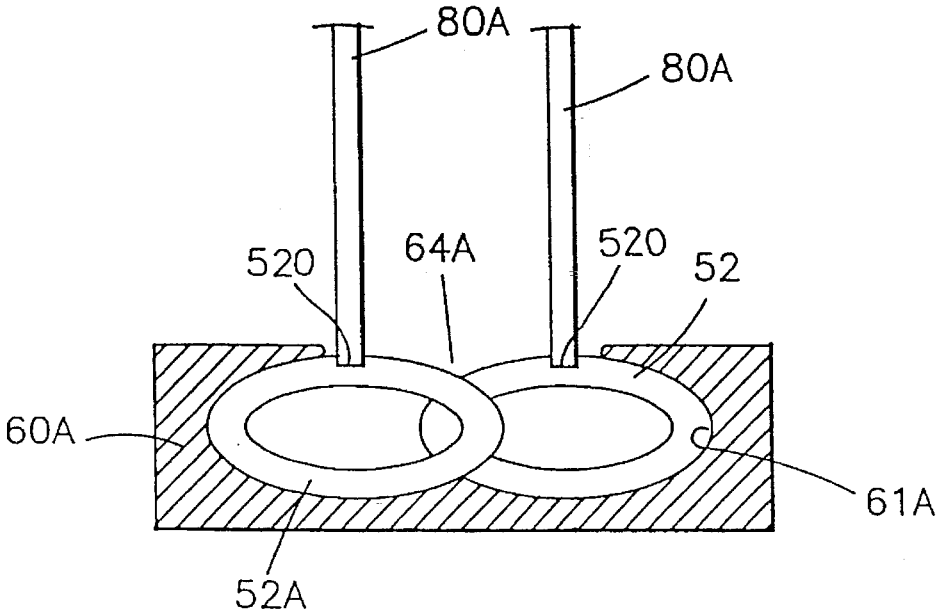
FIG. 6 shows a second preferred embodiment of a tooth-notching unit provided in a slide fastener constructing machine according to the present invention.

FIG. 6 shows the second preferred embodiment which allows two interconnected stringers of teeth 52 and 52A to be machined with a notch 520 at the same time. This allows the manufacture to be more efficient. In this tooth-notching unit, the guiding base 60A employed here is provided with a wider passage 64A and a pair of grinding wheels 80A (or knives) are used.

Figure 7A:
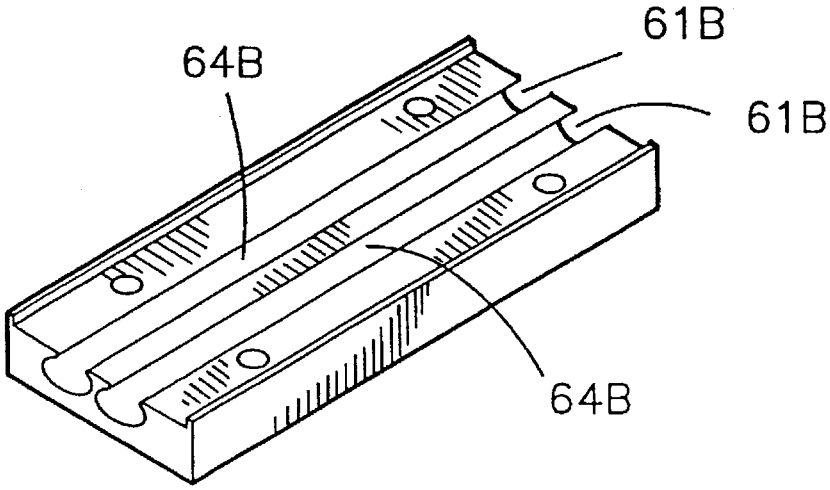
FIG. 7A shows a second type of passage provided on the base portion of the tooth-notching unit.
Figure 7:
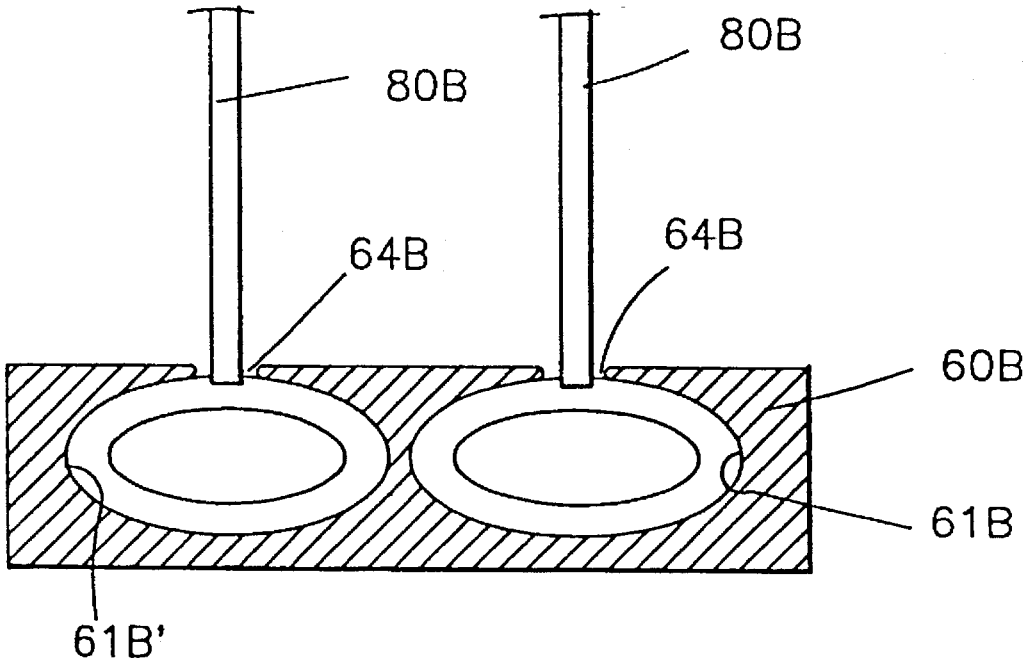
FIG. 7 shows a base portion used in the third preferred embodiment of the present invention.

FIGS. 7 and 7A show the third preferred embodiment which allows the two stringers of teeth to be notched before they are interconnected. In this embodiment, two passages 61B are provided, respectively for guiding the two stringers of teeth.

Figure 8:
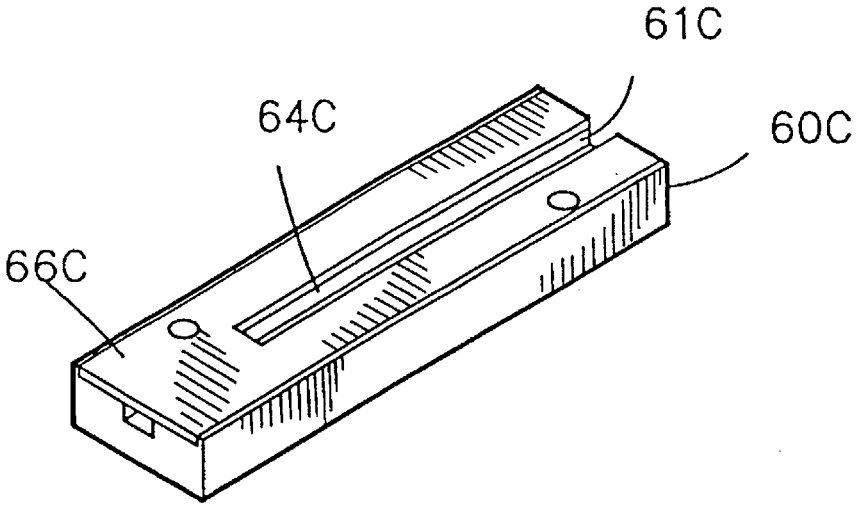
FIG. 8 shows the base portion of a tooth-notching unit in the fourth preferred embodiment.
Figure 9:
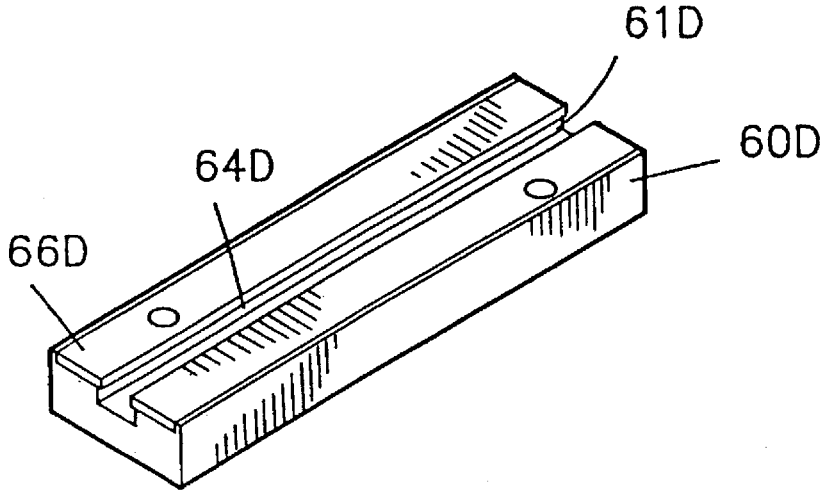
FIG. 9 shows the base portion of a tooth-notching unit in the fifth preferred embodiment.

FIGS. 8 and 9 respectively show the fourth and the fifth embodiments of the present invention, which allow the machining of the guiding base to be made easy. The guiding base of FIG. 8 includes a block 60C provided with a passage 61C of a rectangular cross section. A plate 66C having a slot 64C narrower in width than the passage 61C covers the top of the block 60C. The narrower width of the slot 64C can prevent the teeth passing through the passage 61C from slipping off. The guiding base of FIG. 9 is similar in structure, which includes a block 60D provided with a passage 61D of a rectangular cross section. A plate 66D having a slot 64D narrower in width than the passage 61D covers the top of the block 60D.

Figure 9A:
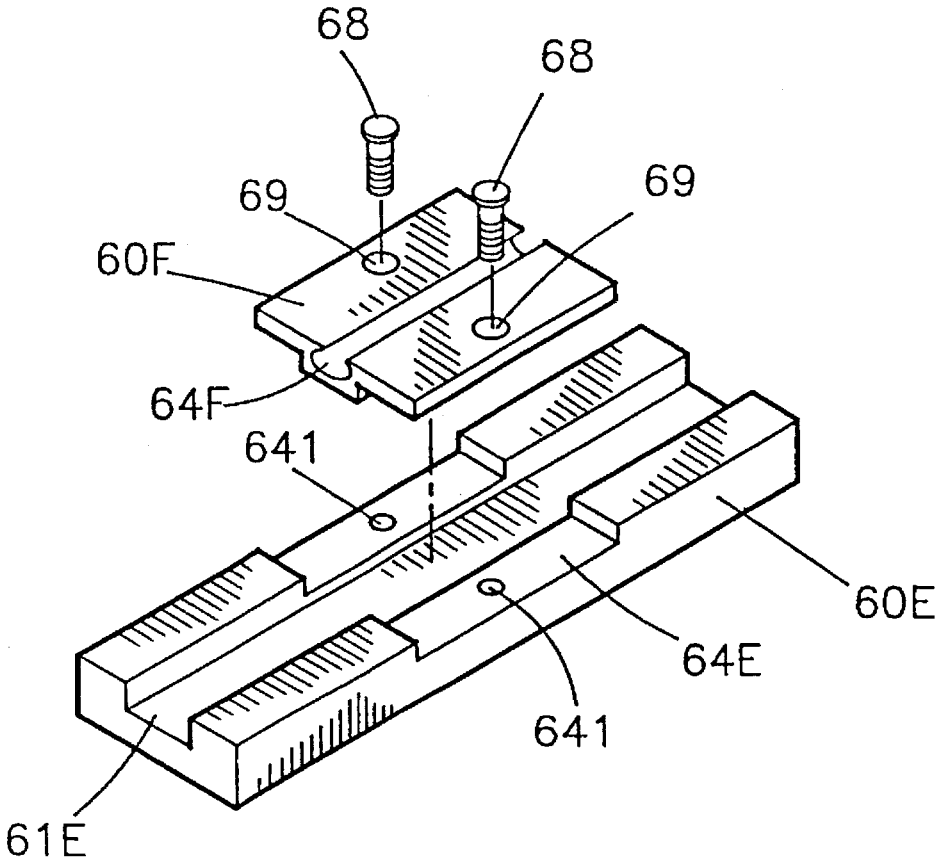
FIG. 9A shows a detachably mounted base portion of a tooth-notching unit in the sixth preferred embodiment.

FIG. 9A shows the sixth embodiment of the present invention, in which the guiding base, here indicated at 60F, is made detachably-mounted onto the guiding base 60E which includes a guiding slot 61E for guiding the stringers of teeth to the guiding base 60F. Similarly in the structure as previous embodiments, the guiding base 60F includes a passage 64F in which the teeth are notched. Screws 68, holes 69 and threaded holes 641 are used to bolt the guiding base 60F onto the guiding base 60E. In operation, a stringer of teeth runs along the guiding slot on the guiding base and then into the passage 64F to be notched there. As previous embodiments, the guiding base 60E can be provided with a single passage which accommodate only a single stringer of teeth as described here, or with a wider passage which can accommodate two interconnected stringers of teeth as that shown in FIG. 6, or with two parallel passages which accommodate two separate stringers of teeth as that shown in FIG. 7A. The advantage to this type of detachable guiding base is that it can be conveniently replaced with a new one when damaged.

Figure 10:
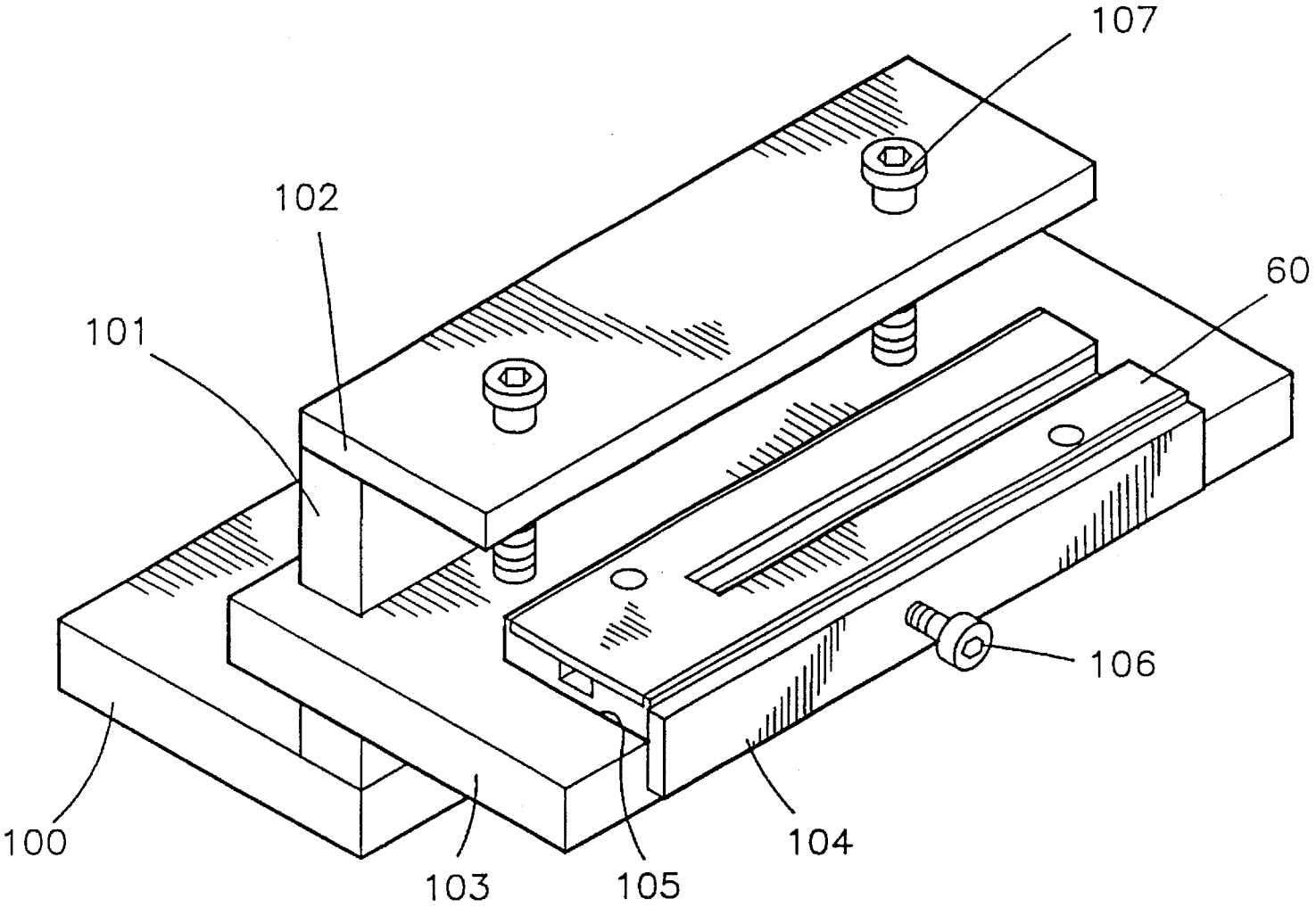
FIG. 10 shows a position-adjustable base portion of a tooth-notching unit in the seventh preferred embodiment.

FIG. 10 shows the seventh embodiment of the present invention, in which the guiding base, indicated here at 60, is mounted on an adjustable mounting base. The mounting base includes a base plate 100, an upright plate 101, a movable plate 103, and a securing plate 102. A pair of adjusting screws 107 are provided on the securing plate 102 for adjusting the vertical position of the guiding base 60; and another adjusting screw 106 is provided on one side of the guiding base 60 for adjusting the horizontal position of the guiding base 60. This embodiment allows the guiding base 60 to be adjusted to any position as required by the machining operation.

Figure 11:
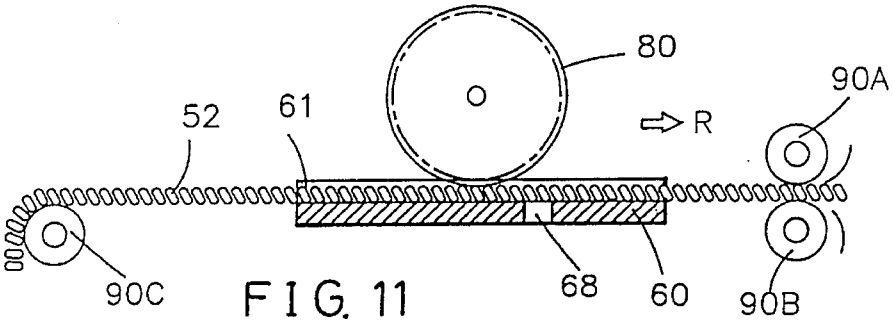
FIGS. 11–15 show various ways of clearing away rubbish produced by the notching of the teeth on the stringer.
Figure 12:
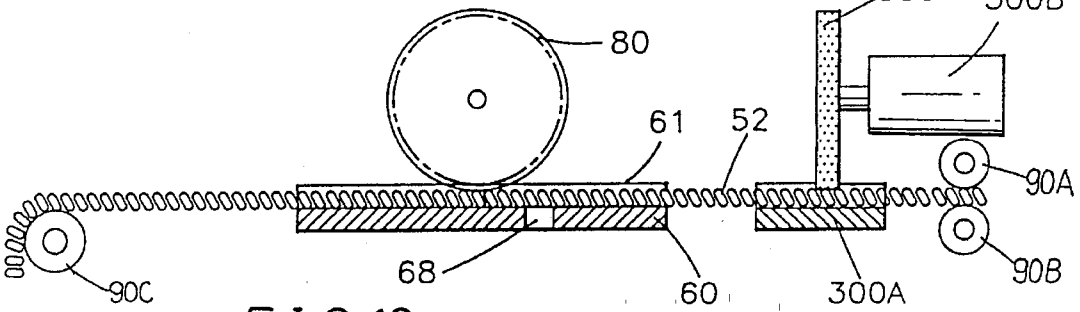

In the next, the operation of the guiding base when installed on a slide fastener constructing machine will be described with reference to FIGS. 11 through 15. Referring to FIG. 11, beside the guiding base the slide fastener constructing machine includes a grinding wheel 80 (or a circular disk cutter) and a pair of rollers 90A, 90B for pulling a stringer of teeth 52. The stringer of teeth 52 passes by another roller 90C and onwards into the passage 61 in the guiding base 60. The direction of conveyance is indicated by the arrow R. Upon passing below the grinding wheel 80, the top of each tooth is cut away to form a notch 520 (shown in FIG. 4) thereon. The rubbish thus produced can be drained away through an opening 68 provided on the bottom of the guiding base 60.

To clear away the remaining rubbish on the teeth 52, a circular brush 300 is provided on top of a base 300A and driven by a motor 300B. The brush 300 moves in a direction perpendicular to the movement of the teeth 52, thus allowing maximum rubbish clearing efficiency.

Figure 13:
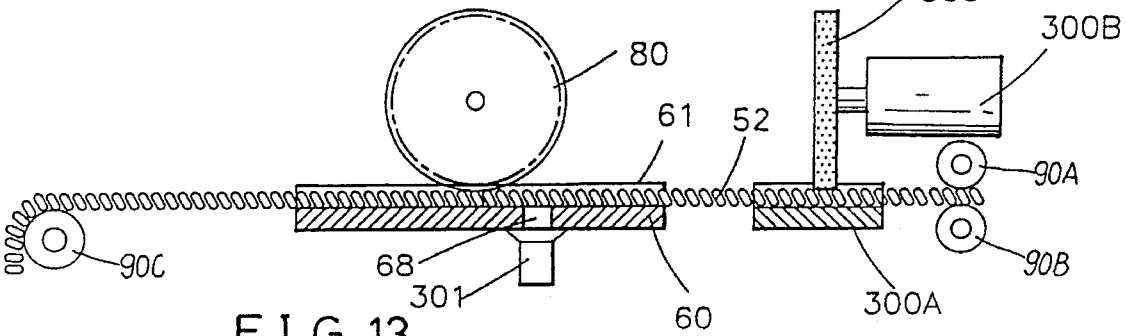
Figure 14:
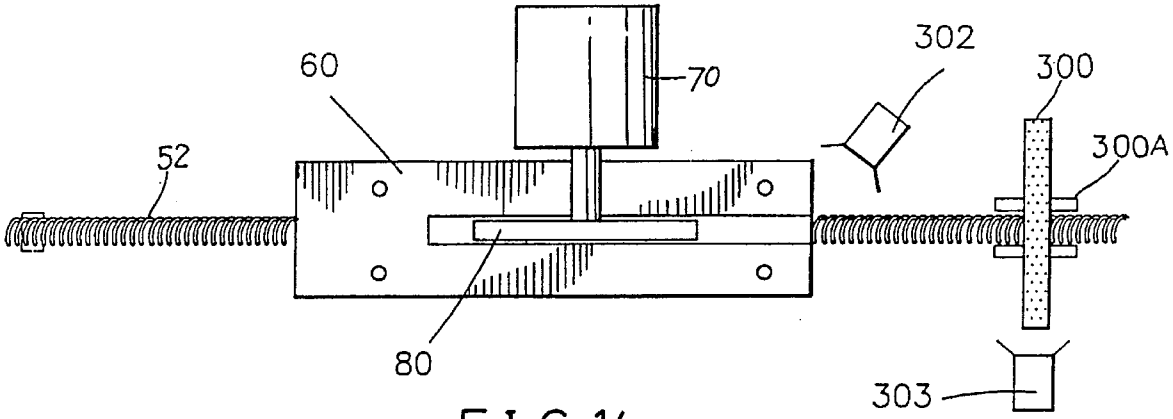

Referring to FIG. 13, a vacuum cleaner 301 can be provided beneath the guiding base 60, with its sucking head coupled to the rubbish draining opening 68. Referring to FIG. 14, in order to further increase the rubbish clearing efficiency, another vacuum cleaner 302 can be provided beside the guiding base 60. The more the rubbish can be cleared away, the better quality of the slide fastener can be produced.

Figure 15:
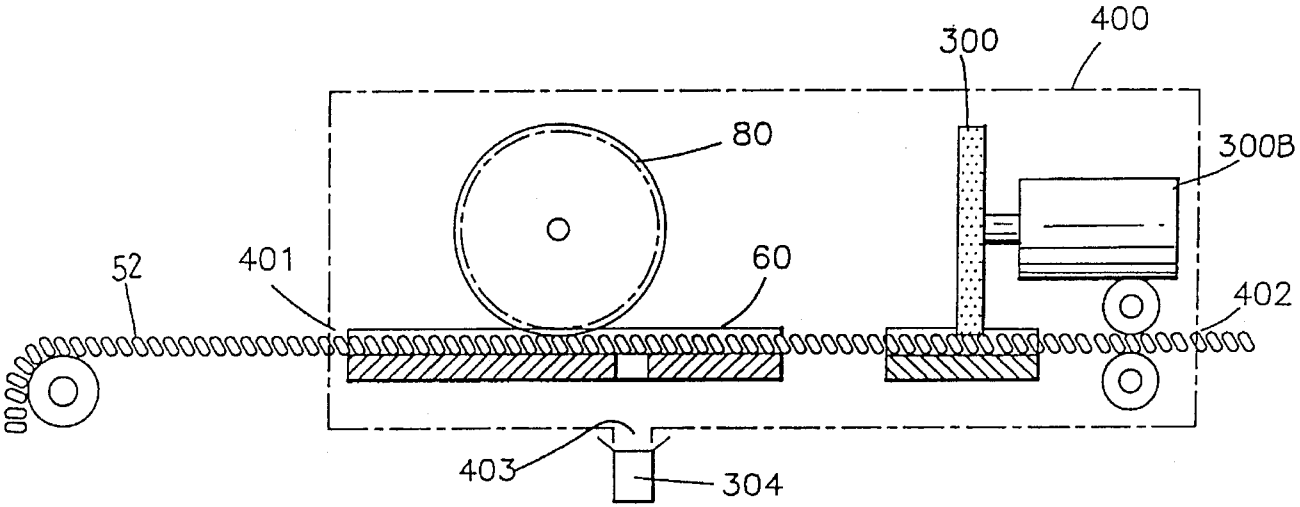

Referring further to FIG. 15, in order to allow the notched portion 520 on teeth 52 to be left without any rubbish, an enclosure 400 can be provided to enclose the guiding base 60, the grinding wheel 80, and the brush 300. An entrance opening 401 is provided on one side of the enclosure to allow the teeth 52 to pass therethrough into the enclosure 400 and a departure opening 402 is provide on the other side for the teeth 52 to pass therethrough out of the enclosure 40. On the bottom side of the enclosure 400 is there provided a rubbish drainage opening 403 coupled to a high-power vacuum cleaner 304. This arrangement allows the machining of the notched portion to be operated in a clean environment.

Figure 16:
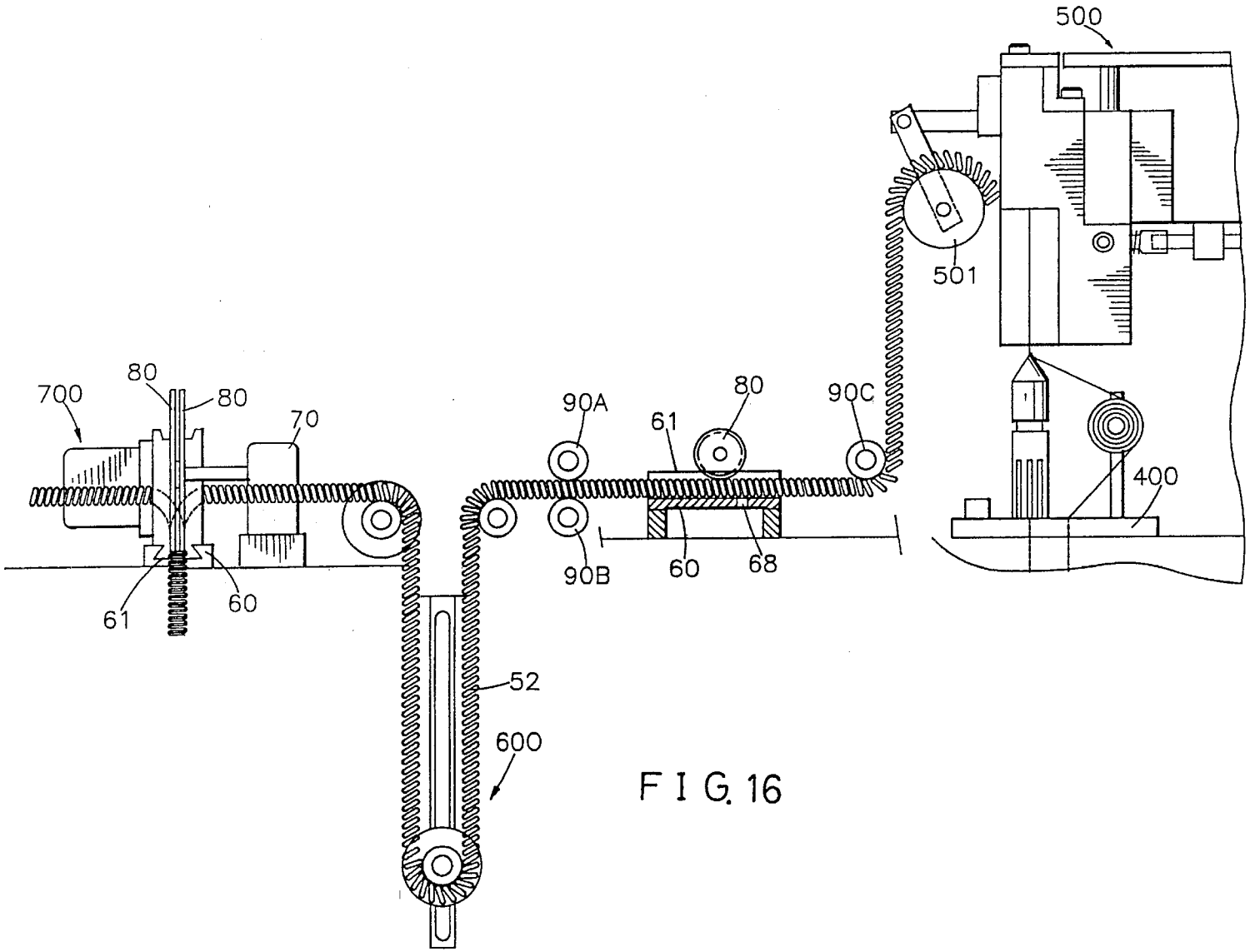
FIG. 16 shows the configuration of the tooth-notching unit installed on a slide fastener constructing machine.

FIG. 16 shows a slide fastener constructing machine which employs a guiding base made according to the present invention. To simply the description of the operation, only the guiding base of FIG. 11 is employed in this slide fastener machine. The mechanism of the machine includes a driving unit (not shown), a rotating table 400, a stringer producing unit 500, a stringer collecting unit 600 and a stringer interconnecting unit 700. In operation, a stringer of teeth 52 is formed through the stringer producing unit 500 and subsequently guided by the roller 501 to the guiding base 60 according to the present invention. Each tooth in the stringer is cut a portion on its top by the grinding wheel 80 to form a notch 520. After that the stringer runs into the stringer collecting unit 600 and the stringer interconnecting unit 700 through the pulling by the rollers 90A, 90B. Finally, the stringer is joined with clothing by making stitches that thread through the notched portion on each tooth. The result is a more secured slide fastener.

Figure 17:
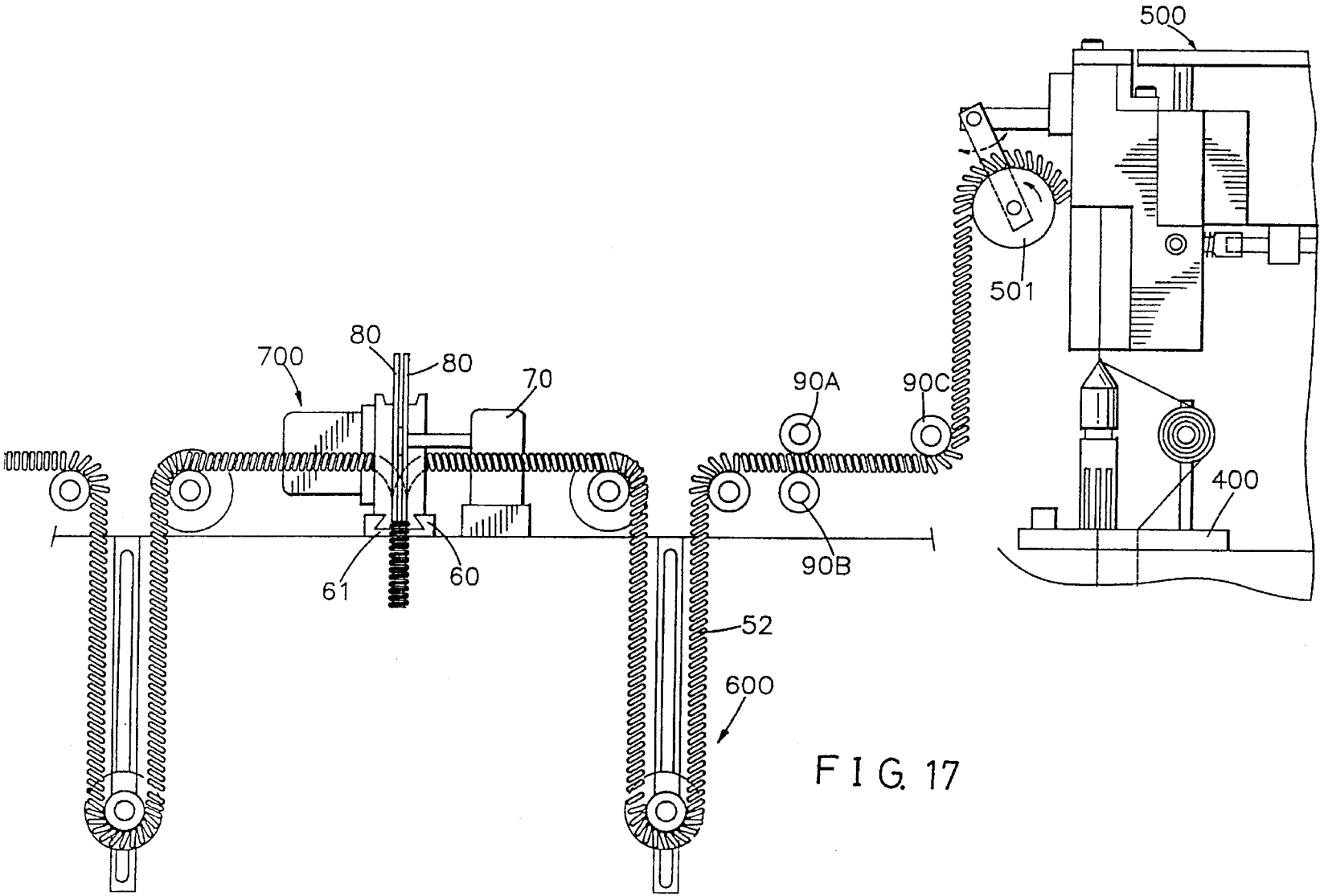
FIG. 17 shows another configuration of the tooth-notching unit installed on a slide fastener constructing machine.

Similarly, as illustrated in FIG. 17, the device according to the present invention can be installed in succession to the stringer interconnecting unit 700. After two stringers are interconnected together, the slide fastener is then guided into the devices 60, 80 (as that shown in FIG. 6) according to the present invention, where the two combined stringers can be cut a portion on their top by two grinding wheels 80—80 to form a notch 520 for each stringer. After that, the slider fastener is wind around a reel and then sent to the next station for final assembly.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A slide fastener constructing machine, comprising:

(a) a stringer producing unit for producing a stringer of teeth;

(b) means for guiding the stringer, said guiding means being provided with a base and at least a passage on said base for allowing the stringer of teeth to pass therethrough;

(c) a tooth-notching unit provided with cutting means, said tooth-notching means receiving the stringer of teeth from said guiding means, and said cutting means cutting a portion of the top surface of each tooth of the stringer away to form a stitch fixing means thereon as the stringer passes beneath said cutting means;

(d) a stringer collecting unit for collecting the stringer having teeth notched by said tooth-notching unit; and (e) stitching means, receiving the stringer from said stringer collecting unit, for making stitches through the stitch fixing means on each tooth of the stringer to stitch the stringer to an article.

2. A slide fastener constructing machine, comprising:

a driving unit;

a rotating table driven by said driving unit;

a stringer producing unit driven also by said driving unit, producing a stringer of teeth;

a stringer collecting unit collecting the stringer coming out from said stringer producing unit in order;

characterized in that means for guiding the stringer and a tooth-notching unit are provided between said stringer producing unit and said stringer collecting unit to enable said guiding means provided with a base and at least a passage on said base for allowing said stringer of teeth to pass therethrough and to have said tooth-notching unit provided with cutting means to receive said stringer of teeth from said guiding means to cut a portion of the top surface each tooth of the stringer away to form a stitch fixing means thereon as the stringer passes beneath said cutting means; and stitching means, receiving the stringer from said stringer collecting unit, for making stitches through the stitch fixing means on each tooth of the stringer to stitch the stringer to an article.

3. A slide fastener constructing machine, comprising:

a driving unit;

a rotating table driven by said driving unit;

a stringer producing unit driven also by said driving unit producing a stringer of teeth;

a stringer collecting unit and a stringer interconnecting unit;

characterized in that means for guiding the stringer and a tooth-notching unit are provided in succession to said stringer interconnecting unit to enable said guiding means provided with a base and at least a passage on said base for allowing said stringer of teeth to pass therethrough and to have said tooth-notching unit provided with cutting means to receive said stringer of teeth from said guiding means to cut a portion of the top surface of each tooth of the stringer away to form a stitch fixing means thereon as the stringer passes beneath said cutting means; and stitching means, receiving the stringer from said stringer interconnecting unit, for making stitches through the stitch fixing means on each tooth of the stringer to stitch the stringer to an article.

4. A slide fastener constructing machine as claimed in claim 1, wherein said passage is provided with a width allowing one stringer to pass therethrough.

5. A slide fastener constructing machine as claimed in claim 1, wherein said passage is provided with a width allowing a pair of stringers to pass therethrough.

6. A slide fastener constructing machine as claimed in claim 1, wherein said base having two parallel passages allowing a pair of stringers to pass respectively therethrough.

7. A slide fastener constructing machine as claimed in claim 1, wherein said base is adjustable in horizontal and vertical positions.

8. A slide fastener constructing machine as claimed in claim 1, wherein said base comprises a plate covering said passage, said plate having a slot provided on top of and along said passage.

9. A slide fastener constructing machine as claimed in claim 1, wherein said based is detachable provided on a guiding base which guides the stringer of teeth into said tooth-notching unit.

10. A slide fastener constructing machine as claimed in claim 1, wherein said base is provided with a rubbish drainage opening for draining rubbish produced by the notching of each tooth on the stringer.

11. A slide fastener constructing machine as claimed in claim 1, further comprising a rubbish-cleaning unit provided in subsequent to said tooth-notching unit for clearing away the rubbish produced by the notching of each tooth on the stringer.

12. A slide fastener constructing machine as claimed in claim 1, further comprising a rubbish-cleaning unit provided in subsequent to said tooth-notching unit for clearing away the rubbish produced by the notching of each tooth on the stringer.

13. A slide fastener constructing machine as claimed in claim 1, wherein said rubbish-cleaning unit comprises a vacuum cleaner for clearing away the rubbish.

* * * * *